US005762051A

United States Patent [19]

Okamoto

[11] Patent Number: 5,762,051

[45] Date of Patent: Jun. 9, 1998

[54] EXHAUST GAS RECIRCULATION SYSTEM FOR AN ENGINE

[75] Inventor: Yutaka Okamoto, Hamamatsu, Japan

[73] Assignee: Sanshin Kogyo Kabushiki Kaisha, Shizuoka-ken, Japan

[21] Appl. No.: 729,350

[22] Filed: Oct. 16, 1996

[30] Foreign Application Priority Data

Oct. 18, 1995 [JP] Japan ..... 7-1270142

[51] Int. Cl.[6] ..... F02M 25/07

[52] U.S. Cl. ..... 123/568; 123/184.31

[58] Field of Search ..... 123/568, 569, 123/570, 571, 184.31

[56] References Cited

U.S. PATENT DOCUMENTS

| | | | |
|---|---|---|---|
| 3,937,194 | 2/1976 | Tamaki et al. | 123/568 |
| 4,328,781 | 5/1982 | Morita | 123/570 |
| 4,615,324 | 10/1986 | Choushi et al. | 123/568 |
| 4,643,157 | 2/1987 | Nishikawa et al. | 123/570 |
| 4,727,848 | 3/1988 | Stumpp et al. | 123/569 |
| 5,203,310 | 4/1993 | Gatellier | 123/568 |
| 5,562,086 | 10/1996 | Asada et al. | 123/571 |

FOREIGN PATENT DOCUMENTS

| | | |
|---|---|---|
| 56-65153 | 6/1981 | Japan . |
| 1-93357 | 6/1989 | Japan . |
| 3-92515 | 9/1991 | Japan . |

*Primary Examiner*—Willis R. Wolfe

*Attorney, Agent, or Firm*—Knobbe, Martens, Olson & Bear, LLP

[57] ABSTRACT

An method and device for controlling the $NO_x$ production of an internal combustion engine having at least one cylinder with a cylinder head and an air intake and exhaust passage is disclosed. The device comprises an exhaust gas recirculation system. In a first embodiment, a portion of the exhaust gas produced by the engine is routed through a by-pass line from the exhaust passage through a valve to the air intake passage. In a second embodiment, the by-pass line extends in the space between the two banks of a "V"-type engine along an intake manifold. In a third embodiment, the by-pass line is a passage extending through the cylinder head from an exhaust passage to a valve having an outlet in communication with the air intake passage leading to that cylinder.

12 Claims, 5 Drawing Sheets

EXHAUST GAS RECIRCULATION SYSTEM FOR AN ENGINE

FIELD OF THE INVENTION

The present invention relates to an exhaust gas recirculation system for controlling the exhaust gas emission of an engine.

BACKGROUND OF THE INVENTION

Engines produce a number of exhaust gases, some of which are considered environmentally undesirable. One of these by-products is $NO_x$ compounds. $NO_x$ compounds are generated during the combustion of hydrocarbon fuels, especially at increased combustion temperatures.

Because automobile engine exhaust gases are discharged into the atmosphere, greater attention has been given emission controls for controlling the exhaust gas content of these engines. The exhaust gases from outboard engines are routed directly from the engine through an exhaust pipe which discharges under the water. This fact, along with the smaller number of engines utilized in outboard motors as compared to automobiles has resulted in less attention being given the exhaust content of these engines.

Whether or not the exhaust gases are discharged into the air or water, exhausting $NO_x$ has detrimental effects on the environment. First, not all of the $NO_x$ that is exhausted into the water from engines of outboard motors remains there. Some volume of the $NO_x$ exhaust is not dissolved into the water and escapes into the atmosphere. This exhaust may either photoreact and create air pollution or chemically react and contribute to acid rain. In addition, in most outboard motors the engine exhaust is not always discharged under water. In order to solve exhaust system backpressure problems, the exhaust gases from the engine are discharged into the atmosphere at low boat speed.

Further, the $NO_x$ which is discharged into and absorbed by the water is readily converted in reduction-type chemical reactions into acid. It has been found that even small changes in pH caused by the introduction of acid into a body of water may have an undesirable effect on plants and wildlife. As a result of these and other concerns regarding the effects of the engine exhaust, many principalities now regulate $NO_x$ output, even from engines of outboard motors.

Controlling the exhaust gas content of engines, both those in automobiles and outboard motors, meets with some difficulties. The engine of an outboard motor is positioned within a very small housing or cowling. Likewise, the engines of newer automobiles must often be positioned in very small engine compartments. In both situations, little space remains apart from the base engine components for emission control equipment. In addition, high engine and emission control component temperatures are sometimes incompatible with certain engine components.

An apparatus and method for use in controlling the content of the exhaust gas produced by an internal combustion engine is desirable.

SUMMARY OF THE INVENTION

The present invention comprises a method of reducing the $NO_x$ exhaust output of an internal combustion engine by utilizing an exhaust gas recirculation system. The exhaust gas recirculation system controls engine emissions, and yet takes up little space and does not interfere with the operation of other engine components.

The system is utilized with an internal combustion engine including at least one cylinder and cylinder head defining a combustion chamber. An intake passage extends to the combustion chamber through the cylinder head. An exhaust passage extends from the combustion chamber through the cylinder head.

The exhaust gas recirculation system comprises a recirculation passage extending from the exhaust passage to the air intake passage. A valve is positioned along the passage for selective opening and closing of the passage.

In a first embodiment, the system is particularly useful when the engine is positioned within a cowling of an outboard motor. The system includes a recirculation line which extends from an exhaust manifold of the engine to a first valve which is in communication with a first branch of an air intake manifold, and a second valve which is in communication with a second branch of an air intake manifold.

A second embodiment system is particularly useful with an internal combustion engine which includes first and second banks containing at least one cylinder. An air intake manifold having first and second branches serves the first and second banks. A first exhaust manifold serves the first bank and a second exhaust manifold serves the second bank.

In this system, a first exhaust gas recirculation line extends from the first exhaust manifold to a first valve positioned along the first branch of the intake manifold. A second exhaust gas recirculation line extends from the second exhaust manifold to a second valve positioned along the second branch of the manifold. The first and second exhaust gas recirculation lines extend between the banks of the engine and along the intake manifold.

A third embodiment of the system is useful with engines in a variety of applications, including those used in automobiles and outboard motors. A recirculation line, in the form of a passage through the cylinder head, is provided for each cylinder. The recirculation line extends from a portion of the exhaust passage positioned in the head. The line extends through the head to a valve, the valve having its outlet in communication with the air inlet passage to the cylinder.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
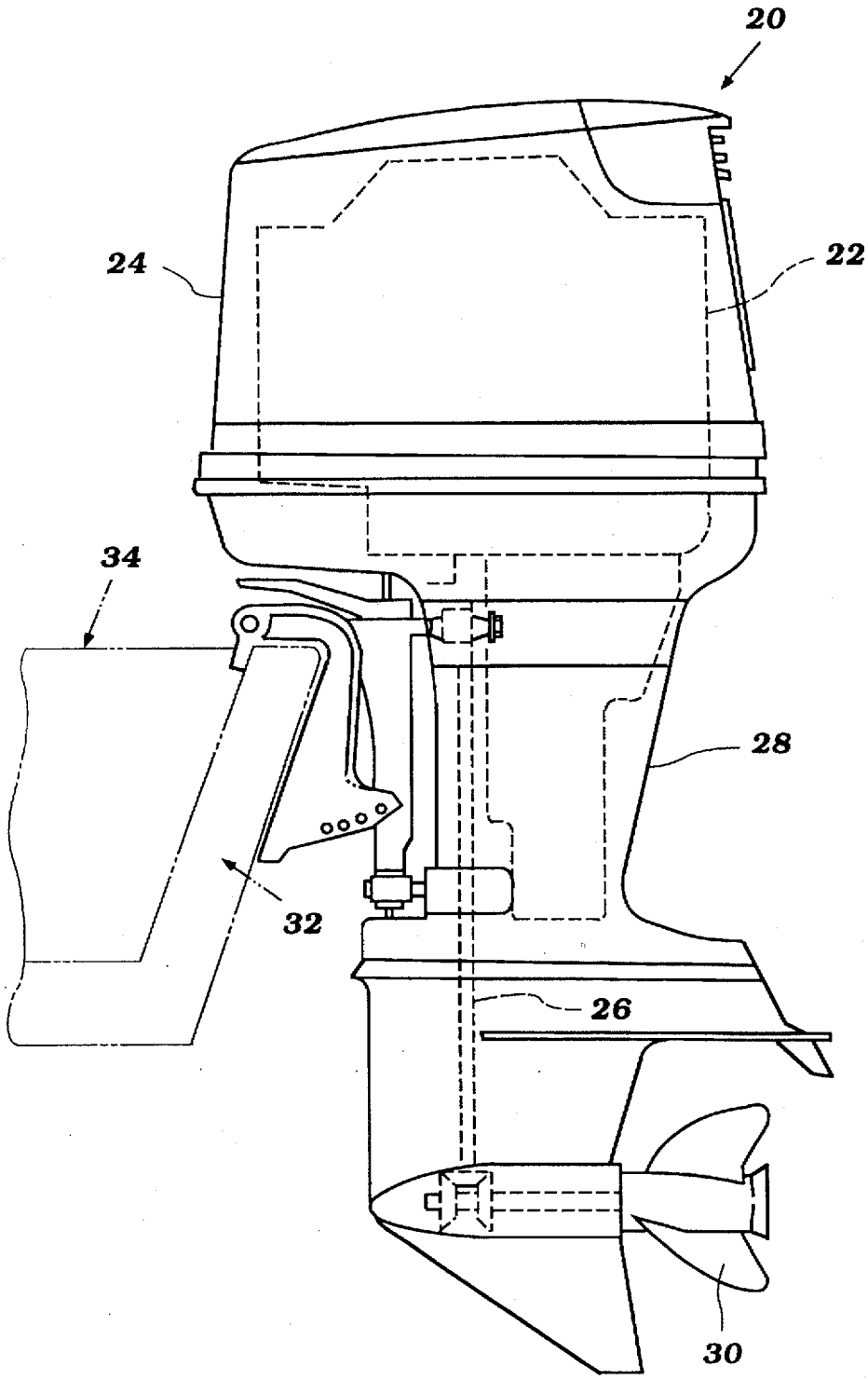
FIG. 1 is a side view of an outboard motor of the present invention, illustrating an engine positioned within a housing of the motor.

FIG. 1 illustrates an outboard motor 20 mounted at the stern 32 of a boat 34. The outboard motor 20 generally comprises an engine 22 powering a propeller 30.

The engine 22 is positioned within a cowling 24. The engine 22 has an output shaft 26. The engine 22 is mounted within the cowling 24 such that its output shaft 26 extends downwardly through a lower drive portion 28 of the motor 20. The output shaft 26 is coupled to the propeller 30.

Figure 2:
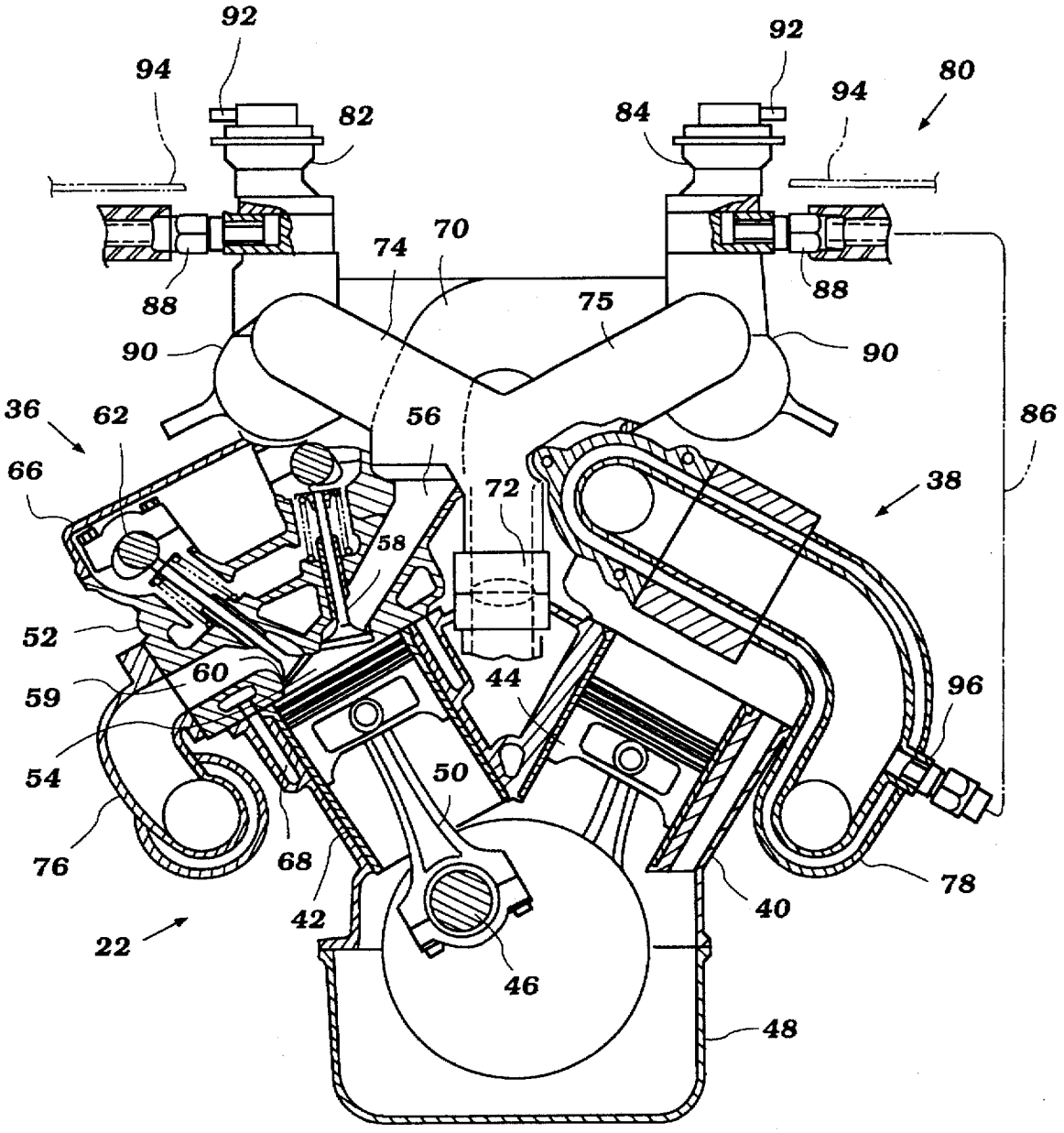
FIG. 2 is a cross-sectional end view of the engine of the motor illustrated in FIG. 1, the engine including a first embodiment exhaust gas recirculation system in accordance with the present invention.

FIG. 2 illustrates the engine 22. The engine 22 is preferably of the "V"-6, four-cycle variety. It will be apparent to those skilled in the art how the invention may be employed with engines having other numbers of cylinders or other types of variable volume combustion chambers. It will also be apparent to those skilled in the art certain facts of the invention may also be employed with rotary or other ported type engines.

The engine 22 has a first bank 36 of cylinders and a second bank of cylinders 38 extending upwardly from a block 40. Each bank of cylinders 36,38 contains three cylinders 42. Each cylinder 42 contains a piston 44 mounted for reciprocal motion.

A crankshaft 46 extends through a crankhousing 48 portion of the engine block 40. Each piston 44 is connected to the crankshaft 46 via a connecting rod 50.

A cylinder head 52 is mounted to each of the cylinder banks 36,38 of the engine 22. As illustrated with respect to a single of the cylinders 42 of the engine 22 in FIG. 2, the cylinder head 52 has recessed portions 54 for forming a combustion chamber with each cylinder 42.

An intake passage 56 extends through the cylinder head 52 to the combustion chamber of each cylinder 42. An exhaust passage 59 extends through the cylinder head 52 from the combustion chamber of each cylinder 42.

Preferably, the engine 22 is of a type which includes two intake and two exhaust ports per cylinder 42. Thus, within the cylinder head 52, each intake passage 58 branches into two portions (see FIG. 5). An intake valve 58 is positioned in each branch of the intake passage 56 at the combustion chamber.

Similarly, each cylinder 42 of the engine 22 preferably includes two exhaust ports corresponding to two branches of the exhaust passage 59, the branches of the exhaust passage 59 merging within the cylinder head 52. An exhaust valve 60 is positioned in each branch of the exhaust passage 59 at the combustion chamber. Each valve 58,60 is preferably spring biased in an upward direction into a closed position. Downward movement or opening of each valve 58,60 is effectuated by a camshaft. A first camshaft 62 is mounted for drawn through an air inlet and air cleaner (not shown) to the air intake passage 72.

Figure 3:
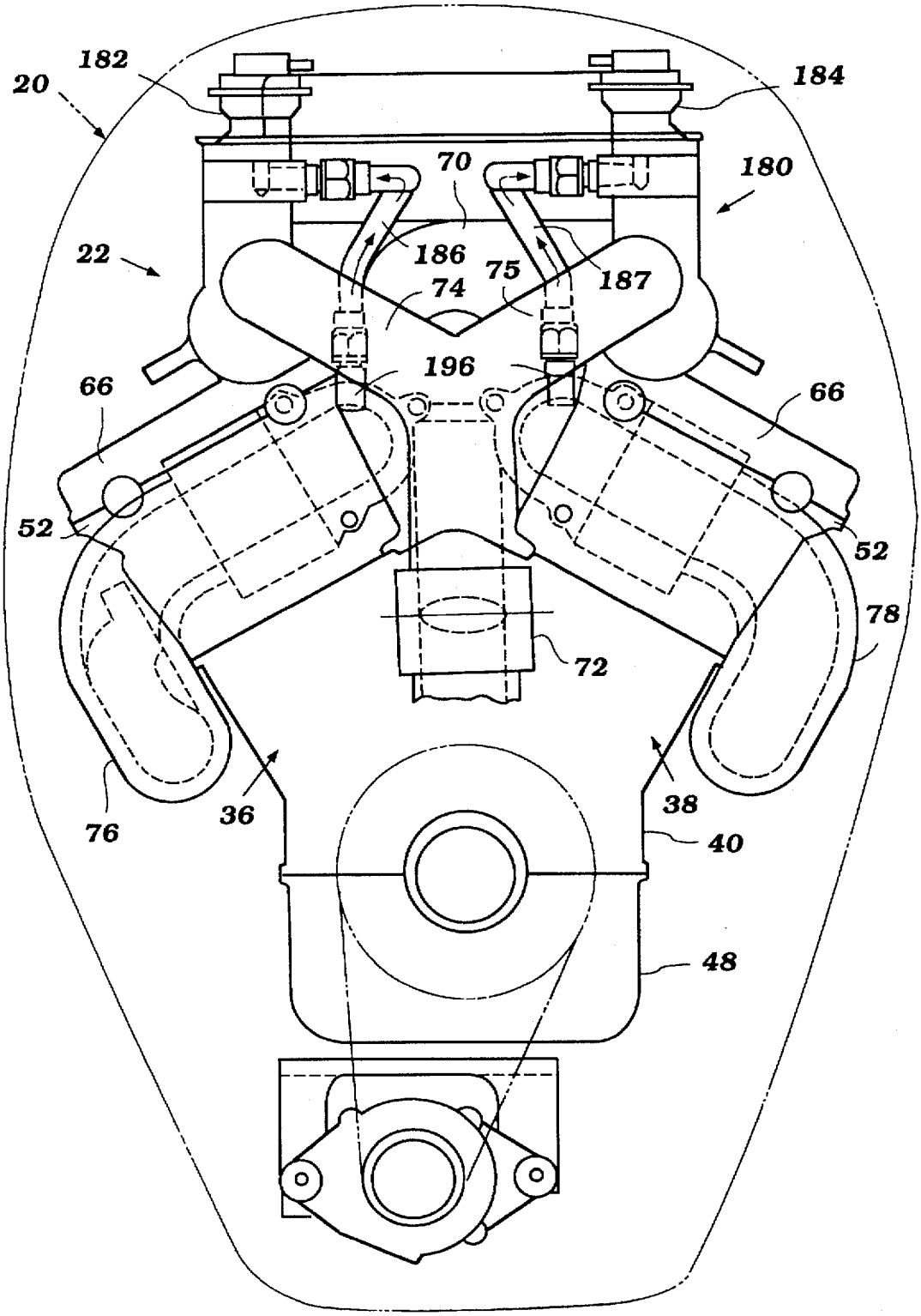
FIG. 3 is an end view of the engine of the motor illustrated in FIG. 1, illustrating a second embodiment exhaust gas recirculation system of the present invention.

As best illustrated in FIG. 3, the intake manifold 70 has a first branch 74 corresponding to the first bank 36 of cylinders, and a second branch 75 corresponding to the second bank 38 of cylinders. Each branch 74,75 of the intake manifold 70 is in communication with the intake passages 56 extending through the cylinder head 52 from the combustion chamber of each cylinder 42. The intake manifold 70 is generally positioned between the banks 36,38 of cylinders. The intake manifold 70 is connected to the cylinder heads 52. The engine 22 includes a pair of exhaust manifolds 76,78. The first exhaust manifold 76 is connected to the cylinder head 52 corresponding to the first bank 35 of cylinders. The second exhaust manifold 78 is connected to the cylinder head 52 corresponding to the second bank 38 of cylinders.

The exhaust manifolds 76,78 are in communication with the exhaust passages 59 extending from the combustion chamber of each cylinder 42. The exhaust manifolds 76,78 are connected at their ends opposite their connection to the cylinder heads 52 to an exhaust pipe (not shown) which routes the exhaust out of the cowling 24.

Fuel is supplied to the engine 22 by means known in the art, preferably by a fuel injector (not shown) mounted for injecting fuel into each cylinder 42. The fuel is supplied from a fuel tank (not shown) with a fuel pump (not shown). Other components of the engine 22, such as an ignition system, engine control and the like are well known in the art and will not be set forth in detail herein.

FIG. 2 illustrates an exhaust gas recirculation (EGR) system 80 in accordance with a first embodiment of the present invention. The EGR system is useful in reducing the level of $NO_x$ gases produced by the engine 22 and contained in the exhaust thereof The first embodiment EGR system 80 includes a first EGR valve 82, a second EGR valve 84, and an exhaust gas by-pass or recirculation line 86.

The first and second EGR valves 82,84 are of the type well known in the art. The valves 82,84 each include an inlet 88 for accepting exhaust gases and an outlet 90 through which the exhaust gases are discharged. A valve (not shown) is positioned within the EGR valve 82,84 for selectively allowing exhaust gas to flow from the inlet 88 to the outlet 90.

Preferably, this valve of the EGR valve 82,84 is operated by low air pressure or a "vacuum" generated by the engine downstream of its connection to each of the exhaust passages 59 corresponding to the combustion chambers of the cylinders 42.

The exhaust gas by-pass line 84 extends from the port 96 in the exhaust manifold 78 to the inlet 88 of each of the EGR valves 82,84. Preferably, the exhaust gas by-pass line 84 comprises a metal tube which is insulated about its outer surface so as not to transmit heat to other portions of the engine 22.

Operation of this first embodiment exhaust gas recirculation system 80 is as follows. When the engine 22 is running, the engine draws air into the air intake 72. The air flows into each branch 74,75 of the manifold. When the intake valve 58 positioned in the intake passage 56 corresponding to a given cylinder 42 opens, air is drawn into the combustion chamber of that cylinders 42.

After combustion in a cylinder 42, the exhaust valve 60 opens and the piston 44 presses the exhaust gases out of the combustion chamber through the exhaust passage 59. These exhaust gases flow into the exhaust manifolds 76,78 and ultimately through the exhaust pipe to discharge.

In accordance with the present invention, when the engine 22 is running, a low air pressure region is created which is transmitted through the vacuum lines 94. This low air pressure causes the valves of each EGR valve 82,84 to open.

When the EGR valves 84,86 are opened, exhaust gases in the exhaust manifold 78 flow into the port 96 and through the exhaust gas by-pass line 86 to the inlet 88 of each EGR valve 82,84. This exhaust gas flows through the outlet 90 of the EGR valve 82,84 and into the each branch 74,75 of the intake manifold 70. The extent to which the valves 82,84 open is proportional to the engine speed, whereby increasing amounts of exhaust gas are routed to the intake and increasing amounts of air are drawn into the intake by the engine.

The exhaust gas which is introduced into the intake manifold 70 through the EGR valves 82,84 mixes with the air drawn through the air intake 72 from the atmosphere by the engine 22. The resultant air charge which is supplied to the engine 22 is a combination of fresh air and exhaust gases. This air charge does not allow combustion as readily as a fresh air charge, such that the resulting maximum temperature generated in the cylinders 42 is lower than would occur if the air charge contained sufficient oxygen to permit complete combustion. As the maximum temperature within the cylinder 42 is lowered, temperatures necessary to achieve $NO_x$ formation are prevented or limited.

One advantage to this system 80 is that only a single exhaust gas recirculation line 84 need be routed from the exhaust manifold to the intake manifold. This arrangement consumes little space and provides for simple installation of the system 80 without interfering with other engine components.

Figure 4:
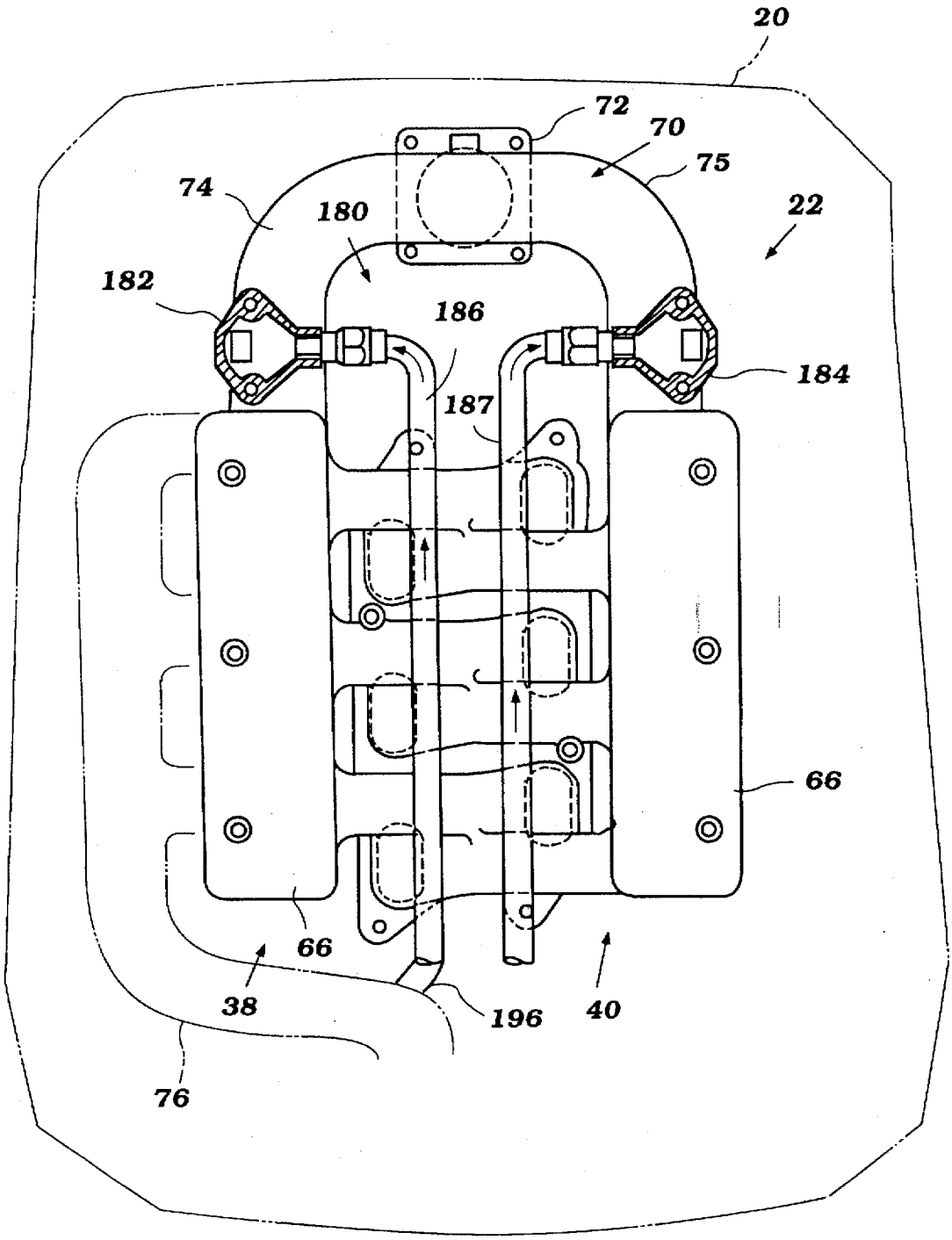
FIG. 4 is a top view of the engine illustrated in FIG. 3.

FIGS. 3 and 4 illustrate a second embodiment exhaust gas recirculation system 180 in accordance with the present invention. The system 180 is illustrated utilized with the engine 22 of the type described above.

The system 180 includes a first EGR valve 182, a second EGR valve 184, and first and second exhaust by-pass lines 186,187. The EGR valves 182,184 are preferably similar to those valves 82,84 described above, and include an exhaust gas inlet and outlet, and an internal valve between the inlet and outlet which is vacuum operated.

The exhaust gas outlet of each valve 182,184 is in communication with the first and second branches 74,75 of the intake manifold 70 of the engine 22. As before, the outlet of each EGR valve 182,184 is preferably positioned downstream of where the air intake 72 meets the intake manifold 70, but upstream of where the manifold and a first intake passage 56 leading to a combustion chamber of a cylinder 42 interconnect.

Each exhaust manifold 76,78 contains a port 196. Each port 196 is positioned downstream of the where the last exhaust passage 59 corresponding to the combustion chamber of a cylinder 42 meets the exhaust manifold 76,78.

One exhaust gas by-pass line 186 extends between the port 196 in the first exhaust manifold 76 and the first EGR valve 182. A second exhaust gas by-pass line 187 extends between the port 96 in the second exhaust manifold 78 and the second EGR valve 84.

As illustrated, the exhaust gas by-pass lines 186,187 extend from one end of the engine 22 to the other between the first and second banks 36,38 and along the intake manifold 70. The routing of the lines 186,187 in this orientation is advantageous since no additional space within the cowling 24 is necessary to accommodate the lines. In addition, the lines 186,187, which tend to reach a high temperature from the exhaust gases, are routed along an area where they do not interfere with other engine equipment which might be damaged if subjected to heat.

Use of this exhaust gas recirculation system 180 is similar to the system 80 described above. With this system 180, however, exhaust gas corresponding to one bank of cylinders is recirculated to the branch of the intake manifold 70 corresponding to only that bank of cylinders.

Figure 5:
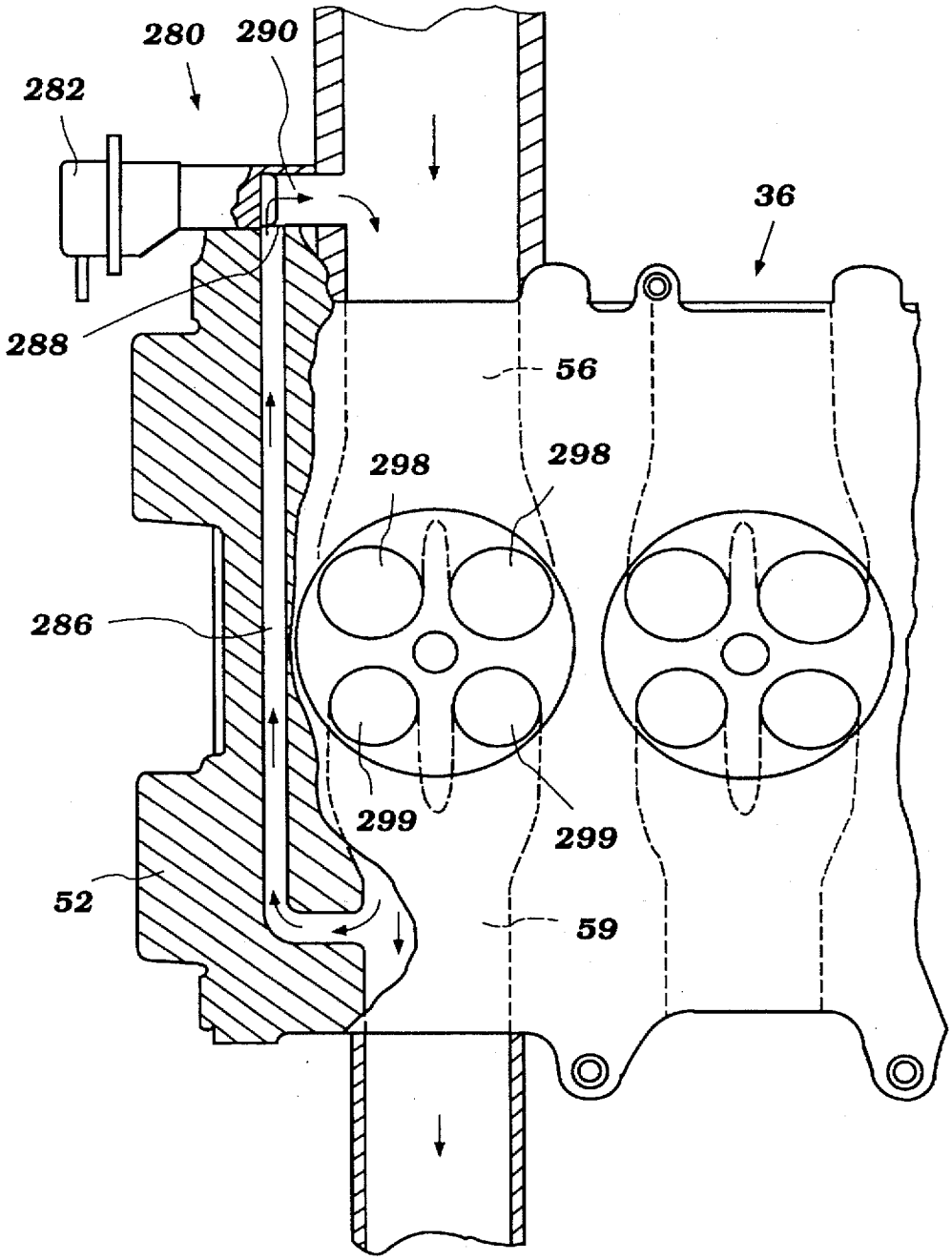
FIG. 5 is a cross-sectional view of a cylinder head of an engine including a third embodiment exhaust gas recirculation system in accordance with the present invention.

A third embodiment exhaust gas recirculation system 280 is illustrated in FIG. 5. This EGR system 280 is useful in with engines utilized in a wide variety of applications, including automobiles and outboard motors.

FIG. 5 illustrates, by way of example, the use of the third embodiment system 280 for use with the outboard motor engine 22 described above. This figure illustrates a pair of adjacent cylinders 42 within one of the banks 36,38 of cylinders of the engine 22. As detailed above, each cylinder 42 has two intake ports 198 and two exhaust ports 199, each having a respective intake or exhaust valve 58,60 positioned therein. The intake passage 56 extends from the intake manifold (see FIG. 1) to the cylinder 42. The exhaust passage 59 extends from the exhaust ports 199 of the cylinder 42 to an exhaust manifold 76,78.

The EGR system 280 in accordance with the third embodiment of the present invention includes an EGR valve 282 and exhaust gas by-pass or recirculation line 286 corresponding to each cylinder 42. The exhaust gas by-pass line 286 comprises a passage through the cylinder head 52 corresponding to the cylinder 42.

The exhaust gas by-pass line 286 extends into the cylinder head 52 from the exhaust passage 59 corresponding to the cylinder 42. The line 286 extends within the cylinder head 52 to the EGR valve 280.

Preferably, the EGR valve 280 is similar to the EGR valves described above. The EGR valve 280 includes an inlet 288 and an outlet 290, and is preferably vacuum operated. As illustrated, the EGR valve 282 corresponding to a given cylinder 42 is positioned adjacent the intake manifold 70/cylinder head 52 connection corresponding to that cylinder 42.

The exhaust gas by-pass line 286 preferably comprises a hollow passageway through the cylinder head 52 from the portion of the exhaust passage within the cylinder head to the EGR valve 182. The line 286 may be formed by boring, molding or the like. Preferably, the entire gas by-pass line 286 is positioned in the head, with the line terminating at the inlet to the valve 182, whereby the only portion of the exhaust gas pathway from the exhaust to the intake passage which is positioned outside of the head 52 is that portion of the pathway through the valve 182.

Preferably, the system 280 includes a by-pass line 286 and an EGR valve 282 corresponding to each cylinder 42. Thus, when the engine 22 has six cylinders arranged as disclosed above, each cylinder head 52 corresponding to a bank of three cylinders has three by-pass lines 286 therethrough. In addition, there are a total of six EGR valves 282, one each positioned along the intake passage 58 to each of the six cylinders 42 of the engine 22.

The third embodiment EGR valve 282 has particular advantageous making it useful with a variety of engines. First, this system eliminates the need for hoses or tubing and the like. This solves the problems in automotive and outboard motor applications where space conservation is a necessity. In addition, since the exhaust gases are not routed through hoses or tubes exterior to the engine, heat is not transmitted through those tubes or hoses to other engine components.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. An internal combustion engine comprising a block defining a first bank having at least one cylinder and a second bank having at least one cylinder, said banks arranged in a "V" configuration defining a valley therebetween, an intake manifold having a first branch corresponding to said first bank and a second branch corresponding to said second bank, an intake passage leading from each branch to each cylinder of its corresponding bank, and an exhaust passage for routing exhaust gases from each cylinder, the engine including an emission control comprising an exhaust gas recirculation system including a first exhaust gas recirculation line extending from an exhaust passage corresponding to a cylinder in said first bank through said valley to an inlet of a first valve, said first valve having an outlet in communication with said first branch and a second exhaust gas recirculation line extending from an exhaust passage corresponding to a cylinder in said second bank through said valley to an inlet of a second valve, said The camshafts 62,64 are journalled for rotation with respect to the cylinder head 52. A valve cover 66 is connected to the head 52. The valve cover 66 extends over and encloses the camshafts 62,64 and the ends of the valves 58,60.

The engine 22 includes a lubrication system (not shown) for lubricating the components of the engine, as is well known in the art. The lubrication system may include an oil sump, a pump, a filter element, and a number of passages through which the oil is routed.

The engine 22 also includes a cooling system. The cooling system includes cooling passages 68 extending through the block 40 and cylinder heads 52. Cooling fluid is forced through the cooling passages 68 as is well known in the art.

An intake system provides an air charge to each cylinder 52 of the engine. The air intake system includes an intake manifold 70. Air is provided to the intake manifold 70 through a main air intake passage 72. Atmospheric air is

3. The engine in accordance with claim 1, wherein said valve is positioned within a valve body, said body connected to said branch.

4. The engine in accordance with claim 1, wherein said valves are movable between a first position in which gases may move from said inlet to said outlet and a second position in which said valve prevents said movement, said valves moved between said first and second positions with air pressure.

5. The engine in accordance with claim 1, wherein each valve is connected to said intake manifold.

6. The engine in accordance with claim 1, wherein said engine includes a first exhaust manifold corresponding to said first bank and a second exhaust manifold corresponding to said second bank, and wherein said inlet of said first line is in communication with said first exhaust manifold and said inlet of said second line is in communication with said second exhaust manifold.

7. The engine in accordance with claim 1, wherein said line comprises an insulated tube.

8. The engine in accordance with claim 1, wherein said line comprises, at least in part, a passage through a cylinder head.

9. An internal combustion engine having a block having a first cylinder head connected thereto and defining a first bank containing at least one cylinder, a second cylinder head connected to said block, and defining a second cylinder bank containing at least one cylinder each cylinder head cooperating with said block to define a combustion chamber corresponding to each cylinder in which combustion occurs, an intake system having a first branch corresponding to said first bank and a second branch corresponding to said second bank, an air intake passage leading from said first branch to the combustion chamber of each cylinder thereof an air intake passage leading from said second branch to the combustion chamber of each cylinder thereof, an exhaust passage extending from each combustion chamber, a first valve having an inlet and an outlet, said outlet in communication with said first branch and a second valve having an inlet and an outlet, said outlet in communication with said second branch, and a recirculation passage extending from one of said exhaust passages through a valley between said banks to the inlet of each of said first and second valves.

10. The internal combustion engine in accordance with claim 9, wherein said valve is air-pressure operated.

11. The internal combustion engine in accordance with claim 9, wherein said valve is positioned within a valve body.

12. The internal combustion engine in accordance with the engine 22 to the vacuum line nipple 92 of each EGR valve 82,84.

The first EGR valve 82 is mounted with its outlet 90 in communication with the first branch 74 of the intake manifold 70. The second EGR valve 84 is mounted with its outlet 90 in communication with the second branch 75 of the intake manifold 70. The outlet 90 of each EGR valve 82,84 is positioned downstream of the connection of the intake manifold 70 to the intake passage 72, but upstream of the intake manifold's extension to the first intake passage 56 corresponding to the combustion chamber of one of the cylinders 42.

In this first embodiment EGR system 80, the exhaust gas by-pass line 84 extends from between one of the exhaust manifolds 76,78 and both EGR valves 82,82, as illustrated in FIG. 2. Preferably, as illustrated in this figure, a port 96 is positioned in the second exhaust manifold 78 of the engine 22. The port 96 is positioned along the exhaust manifold 78